United States Patent [19]

Hinsperger

[11] 4,379,351

[45] Apr. 12, 1983

[54] DEBRIS TRAP FOR POOL COVER

[76] Inventor: Cornelius A. Hinsperger, 28 Columbus Crescent, Guelph, Ontario, Canada

[21] Appl. No.: 249,233

[22] Filed: Mar. 30, 1981

[30] Foreign Application Priority Data

Mar. 24, 1981 [CA] Canada ..... 373575

[51] Int. Cl.[3] ..... E04H 3/19

[52] U.S. Cl. ..... 4/498

[58] Field of Search ..... 4/498–503, 4/490; 242/86.52

[56] References Cited

U.S. PATENT DOCUMENTS

| | | | |
|---|---|---|---|
| 3,128,478 | 4/1964 | Beal | 4/499X |
| 3,982,286 | 9/1976 | Foster | 4/502 |
| 4,089,074 | 5/1978 | Sermons | 4/490 X |

*Primary Examiner*—Charles E. Phillips

*Attorney, Agent, or Firm*—Browdy and Neimark

[57] ABSTRACT

A cover for a swimming pool or like body of water having a trap in the form of a pocket to retain accumulated debris during removal of the cover from the pool. An inwardly open pocket is provided along at least one peripheral edge of the cover and upper and/or lower sides of the pocket are perforate permitting the passage of water while retaining debris.

16 Claims, 8 Drawing Figures

DEBRIS TRAP FOR POOL COVER

The present invention relates to a cover for a swimming pool or other outdoor body of water and which is subject to the accumulation of dirt and other debris during use. More specifically, the present invention relates to a swimming pool cover having means associated therewith to retain accumulated debris during removal of the cover from the pool.

The debris trap according to the invention can be incorporated during the manufacture of the pool cover or can be suitably secured either permanently or temporarily to existing pool covers to obtain the same advantageous results.

In its broad aspects, the invention relates to a cover for a swimming pool or like body of water having at least one pocket on the upper side thereof with the material forming the upper and/or lower sides of the pocket being perforate enabling passage of water therethrough while retaining accumulated debris during removal of the cover from the pool.

In a further embodiment, the present invention relates to a debris trap adapted for removable securement to a cover for a swimming pool and which comprises an inwardly (with respect to the cover) open pocket or scoop formed of buoyant support members partially covered with perforate material permitting the passage of water therethrough, and means to secure the trap to the cover.

The present invention is applicable to and useful with both winter and summer types of pool covers. Winter poolcovers are usually of a size larger than the surface area of the body of water to be covered and these covers are positioned over the water and around the swimming pool structure and suitably held in position through the winter months by sand bags, blocks, tying or other suitable means. Pool covers for summer use are usually of a size which just cover the water in the pool and these are of lightweight flexible material which are easily positioned and removed at frequent intervals during the summer months. The advantage of a swimming pool cover for summer use is that excess evaporation is prevented and the cover functions as a solar or thermal blanket to increase water temperature in the pool during sunlight use while retaining the heat in the pool through the cooler night hours.

During use, both the winter and summer type covers are subject to the accumulation of dirt and assorted debris and in the present specification, the word "debris" is meant to include dirt, leaves, twigs, grass and grass clippings as well as other materials which accumulate on pool covers during extended or short term use.

Examples of existing pool covers which are flexible and buoyant and which are manually positioned and removed are the SEALED AIR cover manufactured and sold by Sealed Air Corporation, and the POLY BUOY (trade mark) cover manufactured and sold by Hinspergers Poly Industries Inc.

DISCUSSION OF PRIOR ART

The difficulties with these existing pool covers which are positioned and removed manually is that it is extremely difficult if not impossible to prevent accumulated debris from falling back into the water of the pool upon removal of the covers. Pool covers particularly of the solar or thermal blanket variety are made of water impermeable sheeting resulting in the formation of pools of water on the surface of the cover as a result of rainfall and dew condensation, and during removal of the cover, this accumulated water flows back into the pool carrying accumulated debris. The accumulation of such water pools may on some occasions not appear to be great, but when one considers the large size of pool covers the total weight of accumulated water can be substantial and it is usually not possible to remove a pool cover without permitting this water to spill into the pool carrying accumulated debris therewith.

U.S. Pat. No. 3,982,286 granted Sept. 28, 1976 to E. G. Foster and Canadian Pat. No. 1,002,420 issued Dec. 28, 1976 to N. J. Maher both disclose pool covers having areas of mesh material provided therein permitting the passage of water while retaining accumulated surface debris. In use, however, these covers have to be lifted vertically either manually (requiring a number of able individuals) or mechanically as in the case of the U.S. Patent if debris is to be obtained and neither of these covers is capable of retaining debris if simply dragged up over the pool edge which is the easiest way of removal and the method which is followed by most pool owners.

OBJECTS OF THE INVENTION

The principal object of the present invention, then, is to provide a trap for a pool cover to retain accumulated surface debris during removal of the cover from the pool while at the same time permitting surface accumulated water to spill back into the pool. In its primary embodiment the present invention provides an inwardly open pocket formed at least partially of perforate material provided adjacent one peripheral edge of the pool cover and which will catch and hold accumulated debris during removal of the cover while permitting the passage of accumulated surface water back into the pool. This pocket or trap can be incorporated into the pool cover at the time of its original manufacture or alternatively can be secured either permanently or removably secured to existing pool covers to obtain the benefits of the inventive concept.

A further object is to provide a pocket or scoop formed of pocket forming buoyant support members partially covered with perforate material and including means for removably securing the scoop along one peripheral edge of a pool cover whereby accumulated debris is retained in the pocket during removal of the cover from a pool.

A still further object is to provide a debris trap for securement to a swimming pool cover to trap and hold debris during removal of the cover from a swimming pool and comprising a strip of flexible mesh adapted for peripheral securement to a portion of the cover, the mesh extending a distance inwardly over the cover to a free inner edge, the mesh and adjacent cover portion providing therebetween a trap in the form of a pocket for the retention of debris during removal of the cover from the pool.

A further object is to provide a cover of flexible material for swimming pools and the like having means to catch and hold debris during removal of the cover from the pool, the debris catching means having a strip or strips of flexible mesh material provided over and along at least one peripheral edge of the cover, the mesh material being secured to the peripheral edge portion and extending inwardly a distance therefrom to a free inner edge, the mesh material and the adjacent cover portion providing therebetween a trap in the form of a pocket for the retention of debris during removal of the cover from the pool.

BRIEF DESCRIPTION OF ACCOMPANYING DRAWINGS

The present invention will now be further described with reference to the accompanying drawings wherein.

DETAILED DESCRIPTION OF ACCOMPANYING DRAWINGS

Figure 1:
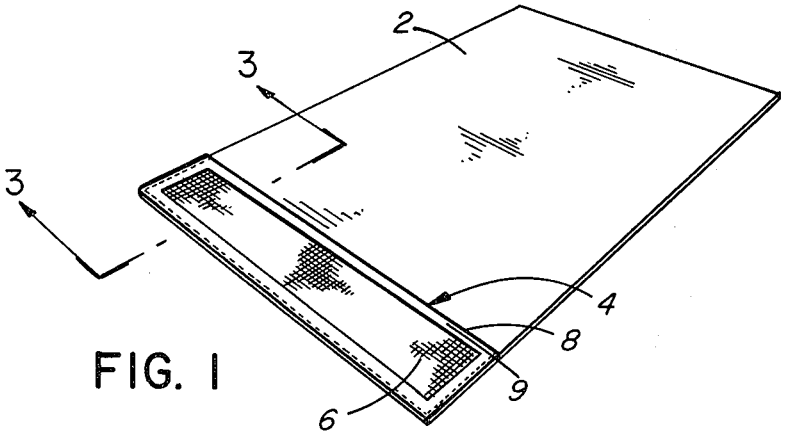
FIG. 1 illustrates in perspective view one embodiment of the present invention used in association with a cover of rectangular configuration.

Reference will now be had to the accompanying drawings wherein like reference numerals refer to like parts.

Throughout the drawings, numeral 2 is used to designate a swimming pool cover for either winter or summer use made of flexible sheeting material suitable for use in such application. The cover may be of any desired size and configuration and suitably may be of canvas, vinyl, woven and coated polyethylene, or other sheet plastic material preferably suitably protected against ultraviolet deterioration. Other materials may be plastic sheeting having solid foam backing or laminated plastic materials.

Figure 2:
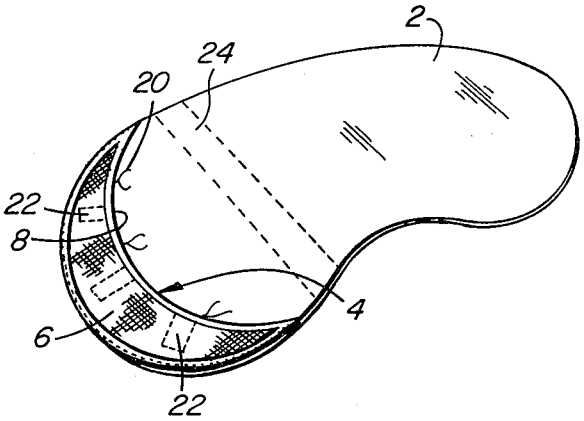
FIG. 2 illustrates an embodiment used in association with a cover of a curving configuration.
Figure 3:
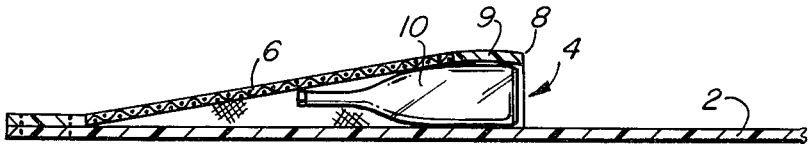
FIG. 3 is a cross-sectional view taken along either of lines 3—3 of FIGS. 1 and 3.

With reference to FIGS. 1, 2 and 3, a pocket generally indicated by numeral 4 is formed along one or more peripheral edges of the cover by layer 6 of perforate material secured peripherally to the cover and providing a free inner edge 8 spaced inwardly from the periphery. An edging 9 of flexible material may suitably be provided along the edge 8 for reinforcement.

Figure 6:
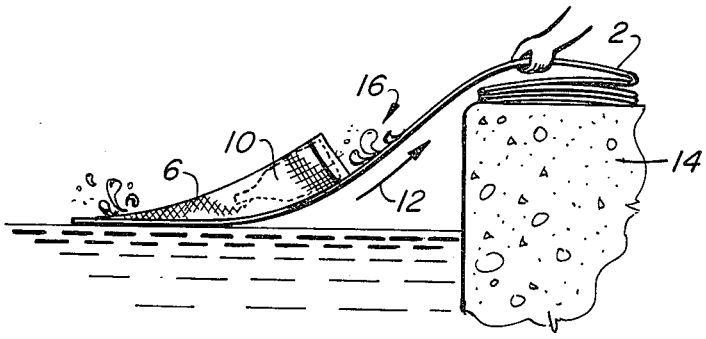
FIG. 6 is a side partially sectioned view showing the pocket retaining accumulated debris during manual removal of the cover from a swimming pool.

Such a pocket 4 need usually be provided only along one end or side edge of the cover 2 but two or more pockets could be provided if desired. FIGS. 1, 2 and 3 show the present arrangement in its simplest form and when covering a pool the perforate material 6 simply overlies the pool cover as shown in FIG. 1. When the cover is to be removed, the pocket may simply be opened by the insertion of buoyant inserts such as plastic bottles 10 as shown in FIG. 3 to hold the inner free edge 8 a spaced distance above the pool cover 2. The pool cover is then dragged from the pool in the direction of arrow 12 and up and over the side of the pool facing 14 in a manner as shown in FIG. 6 with the result that accumulated surface water and debris shown generally at 16 will flow downwardly into the pocket with the surface water passing through the layer 6 which retains the accumulated debris. After the cover 2 has been completely removed from the pool, the debris can then simply be removed from the pocket.

The simple positioning of means such as bottles 10 before removal of the cover has proved most satisfactory. However, and as shown in FIG. 2, means can be provided to hold the bottles (or other buoyant inserts) in position in the pocket 4, and these such holding means can conveniently consist of ties 20 or pockets 22 provided in either the pool cover or perforate layer 6.

In preferred construction, the layer 6 will be of flexible mesh or screen material made suitably of plastic such as vinyl coated polyester mesh, fiberglass screening, or other lightweight flexible mesh screening having suitably sized mesh openings permitting passage of water therethrough while retaining substantially all of the accumulated debris.

The mesh layer can suitably be incorporated in the pool cover at the time of manufacture by suitable means such as by sewing. Attachment could alternatively be by rivets, heat-sealing, adhesives, tie strips, fastening strips of hook-and-eye type commonly sold under the registered trade mark VELCRO, and the like; and similar fastening means can be used to either permanently or temporarily secure a debris trap on existing pool covers.

Preferably, the width of mesh layer 6 will be somewhat greater than the width of the underlying pool cover enabling the formation of a conveniently sized pocket opening, the screen material being suitably pleated at the time of its securement peripherally to the pool cover.

FIG. 3 illustrates mesh material overlaying a portion of a pool cover which usually is of water impermeable sheeting. It will be appreciated, however, that the portion of the pool cover 2 underlaying the mesh layer 6 could also be of perforate material; and that the layer 6 could itself be of imperforate material with the underlying portion of the cover providing the perforations for the passage of water therethrough.

It is preferred that the pocket be provided peripherally along one edge of the pool cover for maximum debris retention. However, in the case of pool covers of irregular curved configuration, the pocket could be provided centrally of the cover as shown in broken lines at 24 in FIG. 2, but with somewhat less advantageous results.

Figure 4:
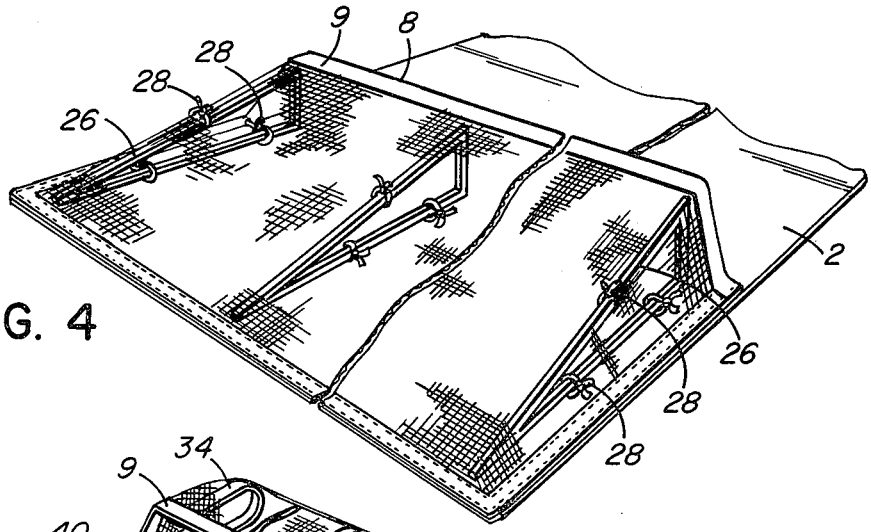
FIG. 4 is a perspective view of a debris pocket of the present invention having pocket forming support means to hold the pocket in open position.

FIG. 4 illustrates an embodiment similar to that illustrated in FIG. 3, but including buoyant support members 26 to hold the pocket 4 in open position and which members can either be permanently or temporarily secured in position. The support members could be received within suitably shaped pockets provided in the layer 6 and/or cover 2 or held in position by tie cords 28 as illustrated.

Figure 5:
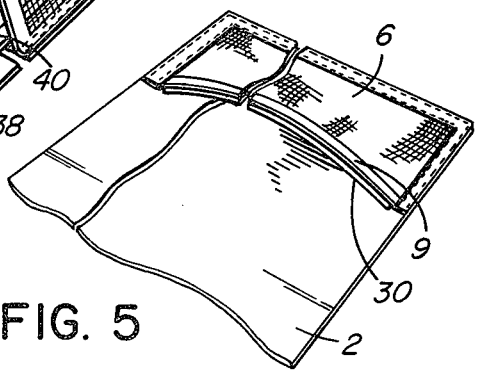
FIG. 5 is a perspective view of one end of a pool cover showing the pocket in open position as the result of the use of an insert.

FIG. 5 illustrates a further embodiment wherein the pocket is held open by the provision of an insert 30 consisting of a length of resilient material. The insert 30 is of a length somewhat greater than the width of the pool cover and upon insertion and with the width of the layer 6 being somewhat greater than the width of the pool cover, the free inner edge 8 of the layer 6 will become bowed in the manner as shown.

Figure 7:
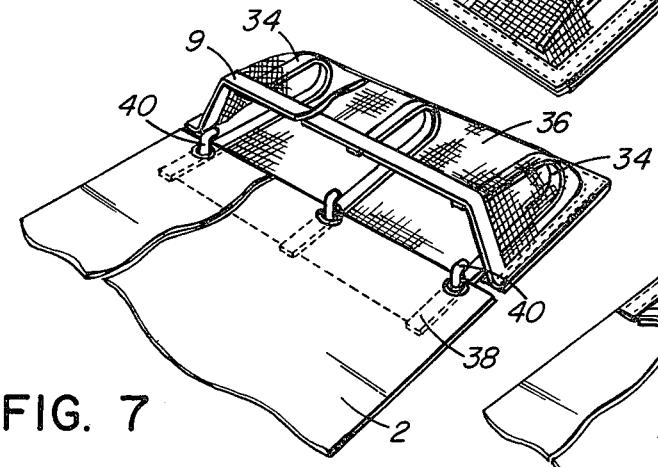
FIG. 7 is a perspective view of a further embodiment illustrating a pocket or scoop adapted for removable securement to a peripheral edge of a swimming pool cover.

A further variation is shown in FIG. 7 which illustrates a pocket or scoop 32 adapted for removable securement across one peripheral edge of a pool cover. The arrangement shown in FIG. 7 consists of a number of buoyant pocket or trap forming support members 34 partially covered with mesh material 36 providing an inwardly open pocket for holding debris. The material 36 may be provided with pockets (not shown) to receive the support members and the bottom, rear and top of the support members as well as the sides of the outer support members will be covered with the mesh providing the inwardly open pocket arrangement as shown. Lower arms 38 of the supports can suitably be provided with hooks 40 for reception within openings 42 provided in the pool cover for removable securement to the pocket to the cover. Other securement means such as tie cords (not shown) could also conveniently be used.

Figure 8:
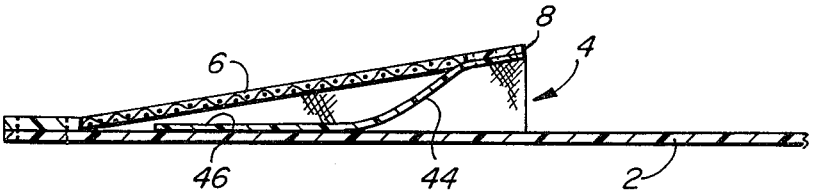
FIG. 8 illustrates in side view a further embodiment including a layer of imperforate material positioned in the debris pocket, and appears on the sheet with FIG. 1.

A further embodiment of the invention is illustrated in FIG. 8, and includes the provision of a flap 44 which extends completely across the pocket and between the mesh layer 6 and the pool cover 2 itself. The flap 44 is secured, suitably by sewing, to the free edge 8 of the mesh layer 6 but its edge 46 which is within the pocket is free. Much debris accumulation is in the form of fine dirt and dust and the flap 44 tends to hold in the pocket the fine dust and dirt particles which would otherwise be carried through the mesh layer 6. With the arrangement shown in FIG. 8, the passage of water around the loose end 46 of the flap is still possible, but much dust and dirt carried by the water flow becomes held within the pocket and from which the dust can be vacuumed after removal of the cover. The flap can either be of impermeable material or be of screening of very small mesh size to catch very small particles.

I claim:

1. A flexible cover for a swimming pool comprising a sheet of flexible material of a size to cover the pool and an upper layer of flexible material overlying a part of the area of said sheet with said upper layer being peripherally secured to said sheet and having a free inner edge, said upper layer and said sheet constituting a pair of cooperating pocket-defining members providing therebetween a pocket having a pocket opening spaced inwardly from an edge of said cover, at least a portion of the material of at least one of said pocket-defining members being perforate permitting passage of water therethrough while retaining in said pocket accumulated debris during removal of the cover from the pool.

2. A cover according to claim 1, wherein said upper layer is formed of flexible perforate mesh material and said sheet is substantially imperforate.

3. A cover according to claim 2, wherein said sheet is of curving configuration, the outer edge of flexible mesh material forming said upper layer being secured peripherally around a curving edge of said sheet.

4. A cover according to claim 2, including spacing means to hold said free inner edge of said upper layer a spaced distance from said sheet.

5. A cover according to claim 2, including means to secure spacing means between said free inner edge of said upper layer and said sheet.

6. A cover according to claim 5, wherein the securing means are pocket or tie cords.

7. A cover according to claim 1, wherein the material forming said upper layer is secured to peripheral edges of said sheet by one of the means selected from the following group: sewed connection, heat seal connection, adhesives, tie cords, staples, or hook-and-eye fastening strips.

8. A cover according to claim 1, wherein said sheet is rectangular, said upper layer being provided across one end or side of said sheet and secured peripherally thereto.

9. A cover according to claim 1, wherein said upper layer is substantially imperforate and said part of the area of said sheet which said upper layer overlies is perforate.

10. A cover of flexible material for swimming pools and the like having means to catch and hold debris during removal of the cover from the pool, said cover comprising a sheet of flexible substantially imperforate material and an upper layer of flexible perforate mesh material positioned over a portion of the upper surface of said sheet, said mesh material being secured to a peripheral edge of said sheet and extending inwardly a distance therefrom to a free inner edge, said mesh material and the underlying sheet portion providing therebetween a pocket having a pocket opening spaced inwardly from an edge of the cover, for the retention of debris during removal of the cover from the pool.

11. A cover according to claim 10, wherein said sheet is of rectangular shape, the upper layer of said mesh material being peripherally secured across one end or side of said sheet.

12. A cover according to claim 10, wherein said sheet is of curving configuration, said upper layer of mesh material being peripherally secured along a portion of a curving edge of said sheet.

13. A cover according to claim 10, at least one of said upper layer or underlying portion of sheet material having pockets or tie cords to receive spacer means to hold said free inner edge of said upper layer spaced from said sheet.

14. A cover according to claim 10, including spacer means positioned between said upper layer and said sheet to hold said free inner edge of said upper layer spaced from said sheet.

15. A cover according to claim 10, wherein the length of said free inner edge of said upper layer is greater than the corresponding distance across said sheet.

16. A cover according to claim 15, including a length of resilient strip approximating the length of said free inner edge of said upper layer positioned adjacent said free inner edge and between said upper layer and said sheet to hold said free inner edge spaced from said sheet.

* * * * *